United States Patent [19]

Sheryll

[11] Patent Number: 4,858,084

[45] Date of Patent: Aug. 15, 1989

[54] ILLUMINATED COASTER FOR A DRINKING VESSEL

[76] Inventor: Richard Sheryll, 340 West 87th St., New York, N.Y. 10024

[21] Appl. No.: 214,287

[22] Filed: Jul. 1, 1988

[51] Int. Cl.[4] ..... F21V 33/00

[52] U.S. Cl. ..... 362/101; 362/154; 362/802

[58] Field of Search ..... 362/96, 101, 154, 800, 362/802; 200/85 R; 248/346.1

[56] References Cited

U.S. PATENT DOCUMENTS

| | | | |
|---|---|---|---|
| 3,878,386 | 4/1975 | Douglas | 362/101 |
| 4,261,026 | 4/1981 | Bolha | 362/101 |
| 4,336,574 | 6/1982 | Goodman | 362/101 |
| 4,344,113 | 8/1982 | Ditto et al. | 362/101 |

*Primary Examiner*—Stephen F. Husar

*Attorney, Agent, or Firm*—Schechter, Brucker & Pavane

[57] ABSTRACT

An illuminated coaster having a minimum number of parts for facilitating assembly and reducing manufacturing costs includes an integral base defining structure for receiving a light, at least one battery, battery contacts, and a switch means for lighting the light when a drinking vessel is disposed in the coaster.

12 Claims, 3 Drawing Sheets

FIG.2
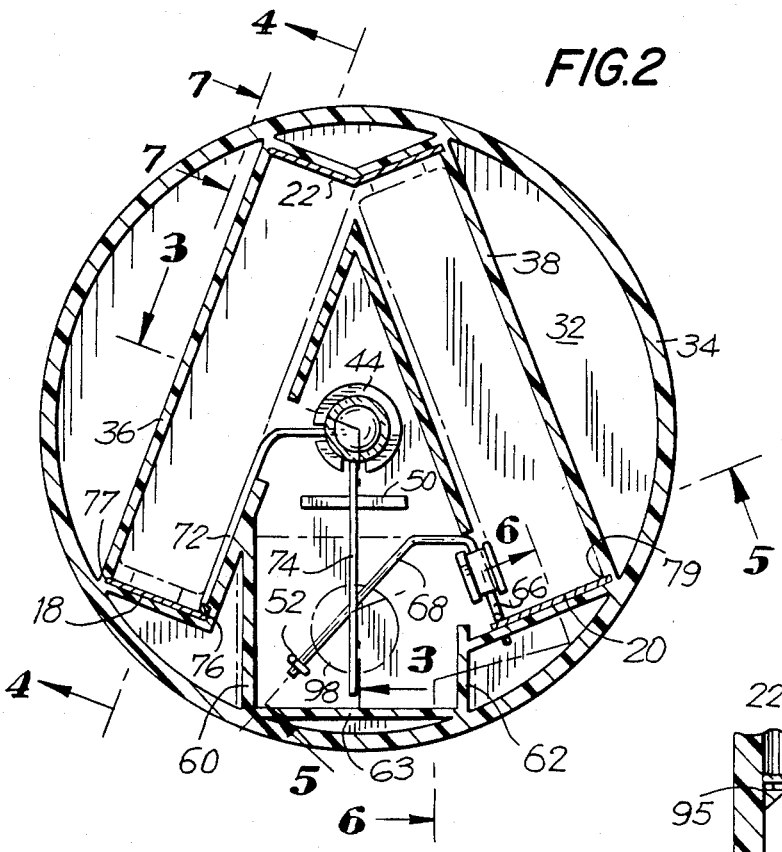
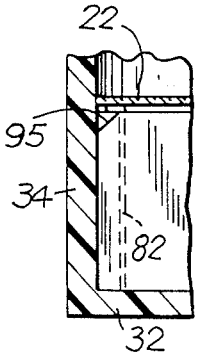
FIG.7
FIG.3
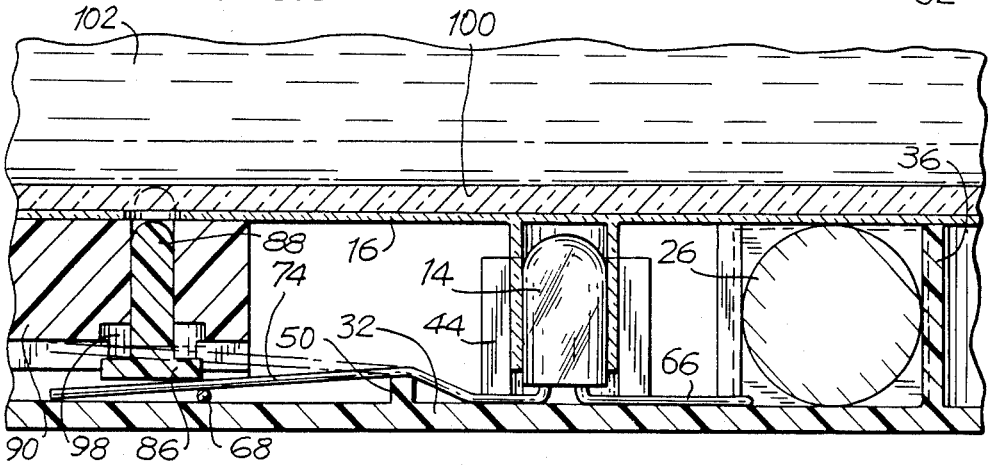

ILLUMINATED COASTER FOR A DRINKING VESSEL

BACKGROUND OF THE INVENTION

1. Field of the Invention

This invention pertains to coasters incorporating illuminating means for lighting a drinking vessel disposed thereon.

2. Prior Art

Many types of illuminated coasters are known in the prior art. For obvious reasons, illuminated coasters are typically battery powered. Several prior art coasters incorporate a switch which must be manipulated by the user to turn the light on and off. This is considered disadvantageous, as it is impractical to rely on consumers to turn the light on and off as necessary. For example, if the light is left on when the coaster is no longer in use, the batteries will be run down, and constant battery replacement can be a considerable expense when compared with the modest cost of the item. Examples of such illuminated coasters are disclosed in U.S. Pat. Nos. 3,878,386 and 4,261,026.

U.S. Pat. No. 4,344,113 discloses an illuminated coaster wherein, in one embodiment, the switch for illuminating the light is activated by the weight of a drinking glass disposed thereon. However, the particular arrangement disclosed is impractical, as it incorporates an excessive number of parts adding to manufacturing costs and assembly time, a serious drawback for a device intended as a premium or for sale at a relatively modest price. U.S. Pat. No. 4,336,574 discloses an illuminated coaster wherein the weight of the glass acts directly on the light for depressing the light and completing the electrical circuit. Such an arrangement, however, can lead to damage to the light if the drink is forcefully placed in the coaster.

It is accordingly an object of the present invention to provide an illuminated coaster which incorporates a minimum number of parts for facilitating assembly and reducing manufacturing costs.

It is a further object of the present invention to provide an illuminated coaster including an integral base incorporating structure for housing the other parts of the device and which, in one embodiment, incorporates means for preventing liquid from contacting the circuit components.

It is a further object of the invention to provide an illuminated coaster which minimizes power consumption for extending battery life.

SUMMARY OF THE INVENTION

To minimize manufacturing costs and assembly time, the coaster in accordance with the present invention incorporates a minimum number of parts. This is largely made possible by an integral base, preferably injection molded from styrene, which incorporates structure for housing the remaining parts of the coaster.

Broadly speaking, the invention comprises a battery powered light having first and second electrically conducting leads; an integral base open at the top comprising a circular bottom wall and a cylindrical sidewall, the base including a plurality of upstanding walls defining a holder for at least one battery, and a cylindrical wall for receiving the light, the cylindrical wall having first and second openings for the first and second leads, respectively; first and second electrically conducting contacts disposed at either end of the holder for contacting the poles of a battery disposed therein; means for securing the first lead of the light to one of the contacts; a third electrically conducting lead and means for securing one end of the third lead to the other of the contacts, the other end of the third lead crossing the second lead; means for biasing the second and third leads in spaced apart relation; and switch means disposed in the base for movement to a first position wherein the second and third leads are in electrical conducting contact when a drinking vessel is disposed in the open top of the base for completing the circuit comprised of the battery and the light thereby powering the light, and a second position wherein the second and third leads are retained by the biasing means in spaced apart relation for opening the circuit when the vessel is out of the holder.

In a preferred embodiment, the light comprises an LED for minimizing power consumption and, to keep the number of parts at a minimum, the biasing means for retaining the second and third leads in spaced apart relation comprises the inherent spring force of one of the leads. Also, in the preferred embodiment the integral base defines an enclosure for the circuit components which is closed at the top by a light transmissive shield for preventing condensate or other liquid from shorting the circuit.

Further features and advantages of the illuminated coaster in accordance with the present invention will be more fully apparent from the following detailed description and annexed drawings of a presently preferred embodiment thereof.

BRIEF DESCRIPTION OF THE DRAWINGS

In the drawings:

FIG. 2 is a sectional view taken substantially along the lines 2—2 in FIG. 1;

FIG. 3 is a sectional view taken substantially along the lines 3—3 in FIG. 2;

FIG. 7 is a sectional view taken substantially along the lines 7—7 in FIG. 2.

DETAILED DESCRIPTION OF THE PREFERRED EMBODIMENT

Figure 1:
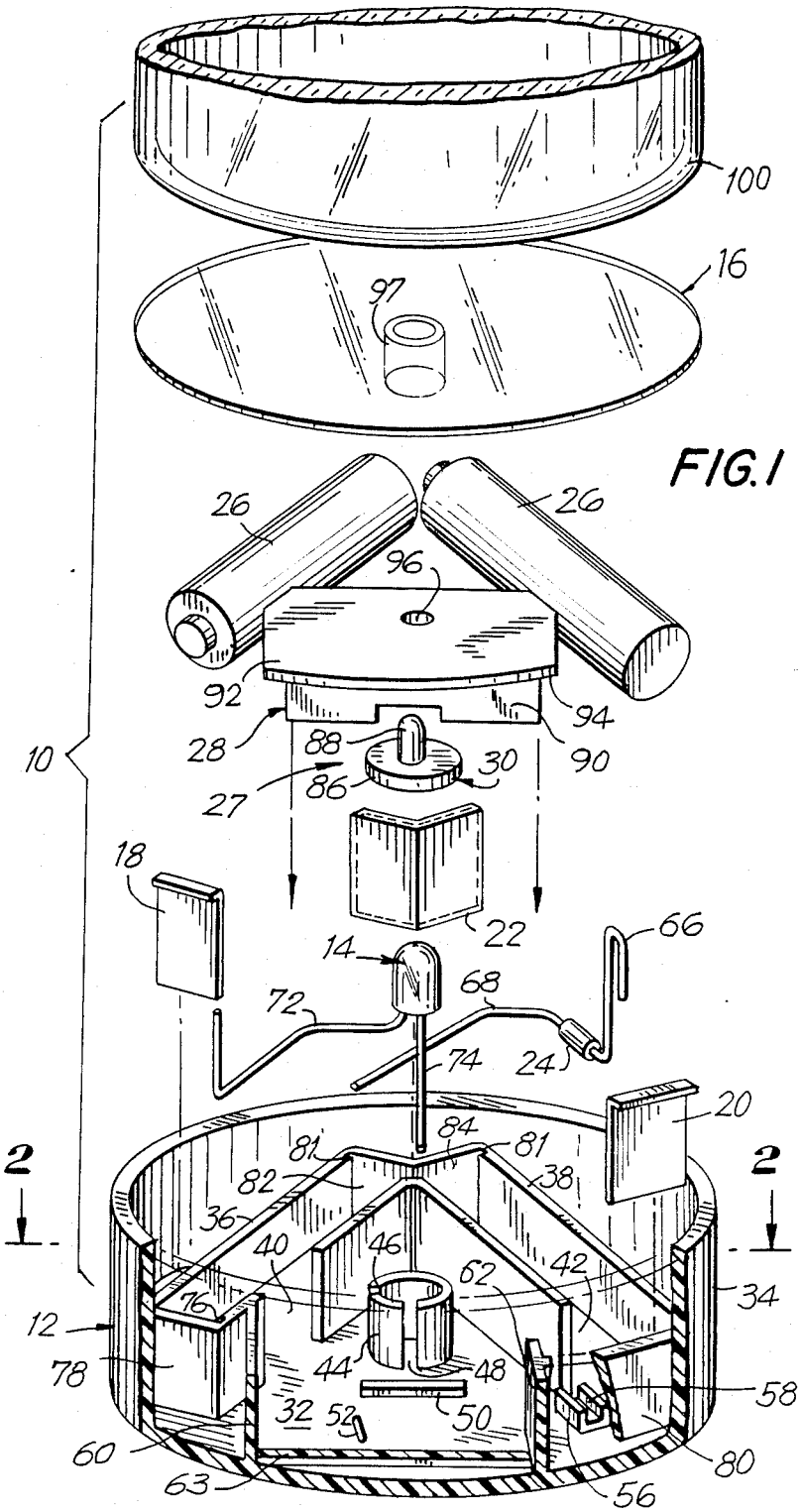
FIG. 1 is an exploded perspective view of the illuminated coaster in accordance with the present invention.
Figure 4:
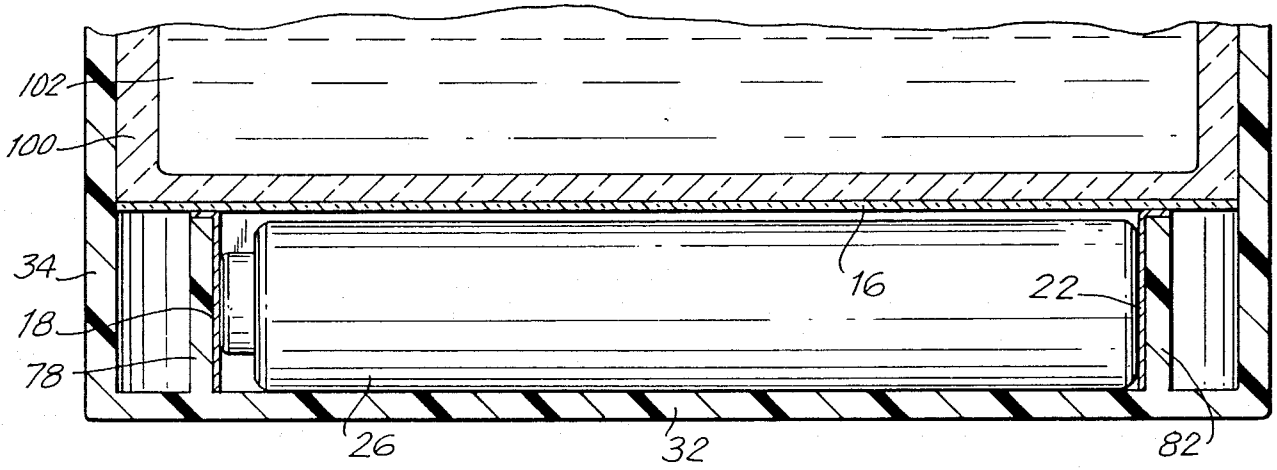
FIG. 4 is a sectional view taken substantially along the lines 4—4 in FIG. 2.
Figure 5:
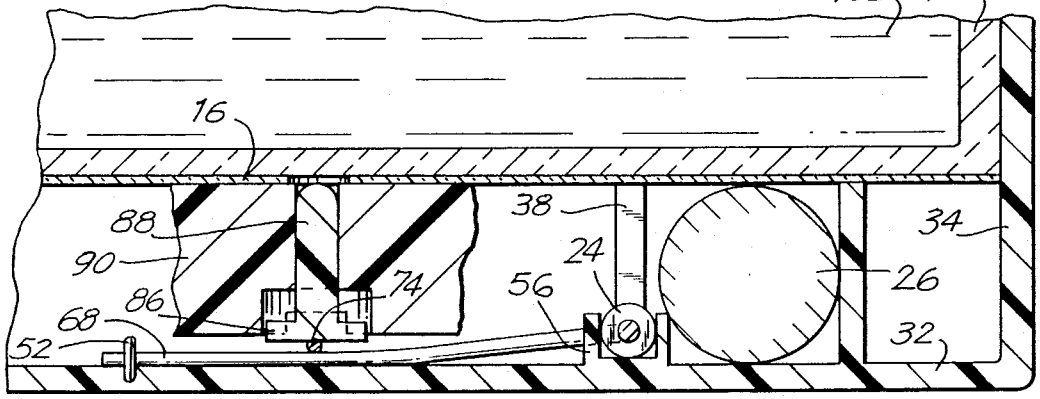
FIG. 5 is a sectional view taken substantially along the lines 5—5 in FIG. 2.
Figure 6:
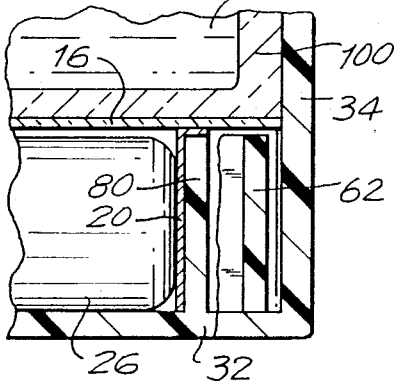
FIG. 6 is a sectional view taken substantially along the lines 6—6 in FIG. 2.

Referring now to the drawings, a preferred illuminated coaster in accordance with the present invention is generally designated at 10. For ease of assembly and reduced manufacturing costs, the coaster 10 is formed with a minimum number of parts. As shown, the coaster 10 includes a base 12, an LED 14, a light transmissive shield 16, battery contacts 18, 20 and 22, a biasing resistor 24, a pair of batteries 26, and a mechanical switch 27 comprised of members 28 and 30.

The base 12 is preferably made of plastic such as high or medium impact styrene, and formed by injection molding. As shown, it comprises a circular bottom wall 32 and a cylindrical sidewall 34. A plurality of upstanding partitions formed on the bottom wall 32 define battery holders 36, 38, the confronting walls of the battery holders 36, 38 defining openings 40 and 42, respectively. Formed substantially at the center of the bottom wall 32 is a cylindrical wall 44 for housing the LED 14, the wall 44 having a pair of openings 46, 48 therein to accommodate wire leads from the LED 14 as will be more fully described below. Also formed on the bottom wall 32 is a bar 50, an angled peg 52, a holder 56 for the resistor 24, and walls 60, 62 and 63 for seating the switch 27.

To assemble the illuminated coaster 10, the battery contacts 18 and 20 are secured to the end walls 78, 80 of the battery holders 36, 38, respectively. Preferably, the vertical corners of the battery holder on either side of the end walls 78, 80 are provided with grooves 76, 77 and 79 such that the contacts 18, 20 may be secured in place by forcing the sides of the contacts into these grooves. The other contact member 22 is then secured to the opposite end walls 82, 84 of the battery holders 36, 38. Preferably, the vertical corners of the end walls 82, 84 are also grooved as at 81 for securing the sides of the contact 22 in place. Preferably the contacts 18, 20, 22 comprise copper or aluminum foil.

The resistor 24 is next placed in the opening 58 defined by the holder 56. With the leads 66, 68 of the resistor 24 bent as shown in FIG. 1, the lead 66 is force-fitted about the wall 80 and the contact 20 thereon such that the lead 66 is in electrical conducting relation with the contact 20. The other lead 68 is placed under the angled peg 52 for holding the lead 68 closely adjacent the bottom wall 32.

Next, the LED 14 is seated in the opening defined by the cylindrical wall 44 with the leads 72, 74 extending through the openings 46, 48 respectively. With the leads 72, 74 bent as shown, the free end of the lead 74 is positioned as shown in FIG. 2. As best shown in FIG. 3, and for reasons that will be explained below, the bar 50 retains the central portion of lead 74 (dotted lines in FIG. 3) in spaced relation from the resistor lead 68. If desired, the end of the lead 74 may be secured to the bottom wall 32 as by an adhesive. The other LED lead 72 extends through the opening 40 into the battery holder 36 where it is seated in the vertical groove 76 on top of contact 18 and in electrical conducting relation therewith.

Once the contacts 18, 20 and 22 are in place, the batteries 26 are disposed in end to end series relation in the battery holders 36, 38 which are dimensioned such that the anodes and cathodes of the batteries 26 are in electrical conducting relation with the contacts 18, 20 and 22.

The next assembly step comprises placement of the mechanical switch 27 comprising the members 28 and 30. As shown, the member 30 comprises a disc-shaped base 86 and a cylindrical projection 88. The member 28 comprises a main part 90 and an integral top 92 defining a ledge or shoulder 94. A hole 96 extends through the member 28, the hole being enlarged on the underside of the main part 90 for defining a recess 98 dimensioned for receiving the base 86 of the member 30 when the projection 88 is disposed in the hole 96. With the part 30 thus disposed in the member 28, the assembly is placed in the base 12 between the vertical walls 60, 62 and 63. When so disposed, the shoulder 94 of the part 28 rests on the walls 60, 62 and 63 for retaining the part 28 in spaced relation from the bottom wall 32 of the base 12.

The final assembly step comprises placing the light transmissive shield 16 inside the cylindrical wall 34 for protecting the circuit components therein from liquid such as, for example, condensate forming on the bottom of a drinking vessel placed in the coaster. As shown, the shield 16 is dimensioned for a close fit inside the cylindrical wall 34 and, when so placed, seats on the walls 60, 62 and 63, and also the walls defining the battery holders 36, 38. Actually, when the coaster is not in use, i.e., there is no drinking vessel therein, the shield 16 is partially supported by the switch member 30 protruding through the hole 96. The shield 16 is sufficiently light that its weight does not move the switch part 30 downward against the bias of lead 74. The shield 16 includes a centered depending hollow cylindrical member 97 dimensioned for seating between the LED 14 and the cylindrical wall 44 for positioning the shield 16 and for firmly seating the LED 14 in place.

As best seen in FIGS. 2 and 7, the wall 60, 62 and 63 together with the walls defining the battery holders 36, 38 define an enclosure containing all the circuit components of the coaster 10. By seating the light transmissive shield 16, any liquid accumulating in the coaster 10 must flow downwardly about the petrify of the shield 16 where in will accumulate in one of the voids outside of this enclosure. To ensure that this is the case, the six points (FIG. 2) where the cylindrical wall 34 contacts the walls defining the enclosure are beveled downwardly toward the cylindrical wall 34 such that any liquid flowing past the shield 16 at these points will also flow down into the spaces outside of the enclosure, one such beveled edge being shown at 95 in FIG. 7.

With the coaster 10 thus assembled, the base 86 of the member 30 rests on the LED lead 74 at its point of crossing with the resistor lead 68 and the projection 88 protrudes slightly above the part 28 (dotted lines in FIG. 3). When the coaster 10 is not in use, the weight of the member 30 is insufficient to deform the LED lead 74 into contact with the resistor lead 68, thereby retaining the circuit defined by the batteries 26, LED 14 and resistor 24, in an open circuit condition. In a preferred embodiment, LED 14 comprises Model No. HBR5566X as manufactured by Stanley Electronic Company, Ltd., resistor 24 comprises a 25 OHM, 1/8 watt resistor, and batteries 26 are Model No. MN2200WOJ, 1.5 volt, as manufactured by Duracell, Inc.

To use the coaster 10, the bottom of a drinking vessel, such as a bottle or the glass 100, is placed inside the cylindrical wall 34 of the coaster 10. When so placed, the bottom of the glass 100, seats on the shield 16, whereupon the weight of the glass 100, acting through shield 16, pushes the switch part 30 downward. Downward movement of the switch part 30, in turn, deforms the LED lead 74 until it contacts the resistor lead 68 therebeneath. Contact between the resistor lead 68 and the LED lead 74 completes the circuit defined by the batteries 26, LED 14 and resistor 24, thereby lighting the LED. Lighting of the LED 14 directs light upward through shield 6, glass 100, and any liquid 102 in the glass, thereby creating a surprising and pleasing aesthetic effect. Specifically, the particular LED selected produces a bulls-eye effect, i.e., a centered column of light with an annular column of light thereabout.

When the glass 100 is removed from the coaster 10, the memory of the LED lead 74 returns that lead to its initial or rest position where it is spaced from the resistor lead 68, thereby reestablishing the open circuit condition in which the LED 14 is off. Preferably, the cylindrical wall 34 of the base 12 is dimensioned for a standard glass size such that there is a close fit between the glass 100 and the cylindrical wall 34. If desired, the outside of the cylindrical wall 34 may be imprinted with a logo, phrase or other design for advertising and/or aesthetic purposes.

While I have herein shown and described the preferred embodiment of an illuminated coaster in accordance with the present invention and have suggested certain changes and modifications thereto, it will be apparent to those of ordinary skill in the art that still further changes and modifications may be made therein without departing from the spirit and scope of the invention. Accordingly, the above description should be construed as illustrative, and not in a limiting sense, the scope of the invention being defined by the following claims.

I claim:

1. An illuminated coaster for a drinking vessel comprising:

a battery powered light having first and second electrically conducting leads;

an integral base open at the top comprising a circular bottom wall and a cylindrical sidewall, said base including a plurality of upstanding walls defining a holder for at least one battery; and a cylindrical wall for receiving said light, said cylindrical wall having first and second openings for said first and second leads;

first and second electrically conducting contacts disposed at either end of said holder for contacting the poles of a battery disposed therein;

means for securing said first lead of said light to one of said contacts;

a third electrically conducting lead, means for securing one end of said third lead to the other of said contacts, the other end of said third lead crossing said second lead;

means for biasing said second and third leads in spaced apart relation; and switch means disposed in said base for movement to a first position wherein said second and third leads are in electrical conducting contact when a drinking vessel is disposed in said open top of said base for completing the circuit comprised of said battery and said light thereby powering said light for illuminating said drinking vessel, and a second position wherein said second and third leads are retained by said biasing means in spaced apart relation for opening said circuit when said drinking vessel is out of said holder.

2. The coaster according to claim 1, wherein said plurality of upstanding walls further define a second holder for a second battery arranged in end-to-end relation with said at least one battery.

3. The coaster according to claim 2, wherein said battery holders meet at one end at an angle, and further comprising a third electrically conducting contact disposed at said angle for establishing electrical contact between said batteries, and wherein said first and second contacts are disposed at the other ends of said battery holders.

4. The coaster according to claim 1, wherein said light comprises an LED, and further comprising a resistor having first and second leads, and wherein said one end of said third electrically conducting lead comprises said first resistor lead, and wherein the other end of said third electrically conducting lead comprises said second resistor lead.

5. The coaster according to claim 4, wherein said base further comprises a first projection dimensioned for securing said resistor in place, and a second projection for receiving and retaining one of said second resistor lead or said second light lead closely adjacent said bottom wall of said base.

6. The coaster according to claim 1, wherein said means for biasing said second and third leads in spaced apart relation comprises the inherent spring force of one of said leads.

7. The coaster according to claim 6, wherein said switch mean comprises a first member seated on the uppermost of said second light lead and said other end of said third lead at their point of crossing, the upper end of said member being contacted by a vessel disposed in said base for moving said switch means to said first position, the weight of said member being insufficient, by itself, to overcome said biasing means for moving said switch means to said first position.

8. The coaster according to claim 7, wherein said base further comprises additional walls defining a chamber for receiving said switch means.

9. The coaster according to claim 8, wherein said switch means comprises a second member defining an opening, said second member being dimensioned for seating in said chamber in spaced relation from said second light lead and said other end of said third lead, and wherein said first member seats in said opening.

10. The coaster according to claim 3, wherein said electrically conducting contacts comprise electrically conducting foil, and further comprising means for securing said contacts in said battery holders, said securing means comprising at least one edge of each contact being deformed into a groove defined in said battery holders.

11. The coaster accordingly to claim further comprising additional walls defining a chamber for receiving said switch means, said plurality of upstanding walls and said additional walls collectively defining an enclosure and at least one space between said enclosure and said cylindrical sidewall, said cylindrical wall for receiving said light and said third lead being disposed in said enclosure whereby all the circuit components of said illuminated coaster are in said enclosure, and further comprising a light transmissive shield disposed above said enclosure, liquid flowing past said shield accumulating in said at least one space for preventing liquid from contacting said circuit components.

12. The coaster according to claim 11, wherein said shield seats on said switch means, the weight of said shield being insufficient to move said switch means from said second position to said first position.

* * * * *